US007710228B2

(12) United States Patent
Feng et al.

(10) Patent No.: US 7,710,228 B2
(45) Date of Patent: May 4, 2010

(54) ELECTRICAL INDUCTOR ASSEMBLY

(75) Inventors: Frank Z. Feng, Loves Park, IL (US); Dwight D. Schmitt, Rockford, IL (US); Steven Schwitters, Rockford, IL (US); Clifford G. Thiel, Lanark, IL (US); Debabrata Pal, Hoffman Estates, IL (US); John Huss, Roscoe, IL (US); John Horowy, Rockford, IL (US); Joseph Sukkar, Rockford, IL (US); Dirk Derr, Shelby, IL (US); Mark Hamilton Severson, Rockford, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 215 days.

(21) Appl. No.: 11/941,103

(22) Filed: Nov. 16, 2007

(65) Prior Publication Data

US 2009/0127857 A1 May 21, 2009

(51) Int. Cl.

| | |
|---|---|
| ***H01F 27/08*** | (2006.01) |
| ***H01F 27/10*** | (2006.01) |
| ***H01F 21/06*** | (2006.01) |
| ***H01F 27/30*** | (2006.01) |
| ***H01F 27/28*** | (2006.01) |
| *H01F 7/06* | (2006.01) |
| *F02N 11/08* | (2006.01) |

(52) U.S. Cl. ..... 336/61; 336/55; 336/57; 336/58; 336/131; 336/170; 336/179; 336/198; 336/196; 336/229; 29/602.1; 29/605; 29/606; 290/48

(58) Field of Classification Search ..... 336/229
See application file for complete search history.

(56) References Cited

U.S. PATENT DOCUMENTS

| | | | | |
|---|---|---|---|---|
| 2,511,230 | A * | 6/1950 | Wald | 336/70 |
| 3,916,286 | A | 10/1975 | Waehner | |
| 4,779,812 | A * | 10/1988 | Fisher et al. | 242/434.7 |
| 4,788,394 | A | 11/1988 | Vanneste | |
| 4,833,436 | A * | 5/1989 | Martin et al. | 336/60 |
| 4,975,672 | A * | 12/1990 | McLyman | 336/198 |
| 5,165,162 | A | 11/1992 | Charles | |
| 5,698,922 | A | 12/1997 | Halter | |
| 5,748,013 | A | 5/1998 | Beauclair | |
| 5,770,982 | A * | 6/1998 | Moore | 333/32 |
| 5,838,220 | A * | 11/1998 | Hagberg | 336/206 |

(Continued)

*Primary Examiner*—Lincoln Donovan
*Assistant Examiner*—Mangtin Lian
(74) *Attorney, Agent, or Firm*—Carlson, Gaskey & Olds

(57) ABSTRACT

An electrical inductor assembly comprises an inductor core having a circular shape, a wire guide that surrounds the inductor core and includes a plurality of slots, at least one of the slots forming a path winding around the inductor core, and at least one wire placed in one of the plurality of slots to form a winding. A method of forming an electrical inductor assembly comprises forming an inductor core having a circular shape, surrounding the inductor core with a wire guide, winding at least one wire around the inductor core along a slot in the wire guide, and applying an insulating material to the slot containing the at least one wire to electrically insulate the at least one wire.

18 Claims, 6 Drawing Sheets

U.S. PATENT DOCUMENTS 5,929,735 A * 7/1999 Heinrich ..... 336/61
6,462,429 B1 10/2002 Dhyanchand
6,512,438 B1 * 1/2003 Yoshimori et al. ..... 336/178
6,707,205 B2 3/2004 Johnsen
6,781,499 B2 8/2004 Steiner
6,781,501 B2 * 8/2004 Layton ..... 336/229
7,068,005 B2 6/2006 Baker
2006/0044103 A1 * 3/2006 Roebke et al. ..... 336/208

* cited by examiner

ELECTRICAL INDUCTOR ASSEMBLY

BACKGROUND OF THE INVENTION

This invention relates to electrical inductors, and more particularly to an electrical inductor for use in a motor control system.

When starting a traditional aircraft engine, a pneumatic starter may be used to rotate a shaft of the engine. Sparks may then be created to ignite a mixture of fuel and air, which may then used to power the aircraft engine. Pneumatic starters, however, may require heavy components, which can decrease aircraft efficiency. Recently, some aircraft have replaced a pneumatic starter with an electric motor mounted on an aircraft engine shaft. A motor controller may be used to deliver power to the electric motor, and the electric motor then rotates the shaft of the aircraft engine. In one example, the electric motor may act as a starter and a generator.

Electrical inductors are commonly used in circuits for various reasons, such as filtering electrical current. A typical inductor includes a core material, and a plurality of insulated wires wrapped around the core multiple times, with each wire corresponding to a phase of electrical current. One application for an inductor is as part of a power filter in a motor controller. In vehicle motor control systems, particularly aerospace engine systems, it is desirable to minimize the size and weight of components. However, reducing the size of an inductor can reduce an inductor's capacity for flux, and can reduce the surface area of the inductor, therefore making heat dissipation more difficult.

SUMMARY OF THE INVENTION

An electrical inductor assembly comprises an inductor core having a circular shape, a wire guide that surrounds the inductor core and includes a plurality of slots, at least one of the slots forming a path winding around the inductor core, and at least one wire placed in one of the plurality of slots to form a winding.

A method of forming an electrical inductor assembly comprises forming an inductor core having a circular shape, surrounding the inductor core with a wire guide, winding at least one wire around the inductor core along a slot in the wire guide, and applying an insulating material to the slot containing the at least one wire to electrically insulate the at least one wire.

These and other features of the present invention can be best understood from the following specification and drawings, the following of which is a brief description.

DETAILED DESCRIPTION OF THE PREFERRED EMBODIMENT

Figure 1:
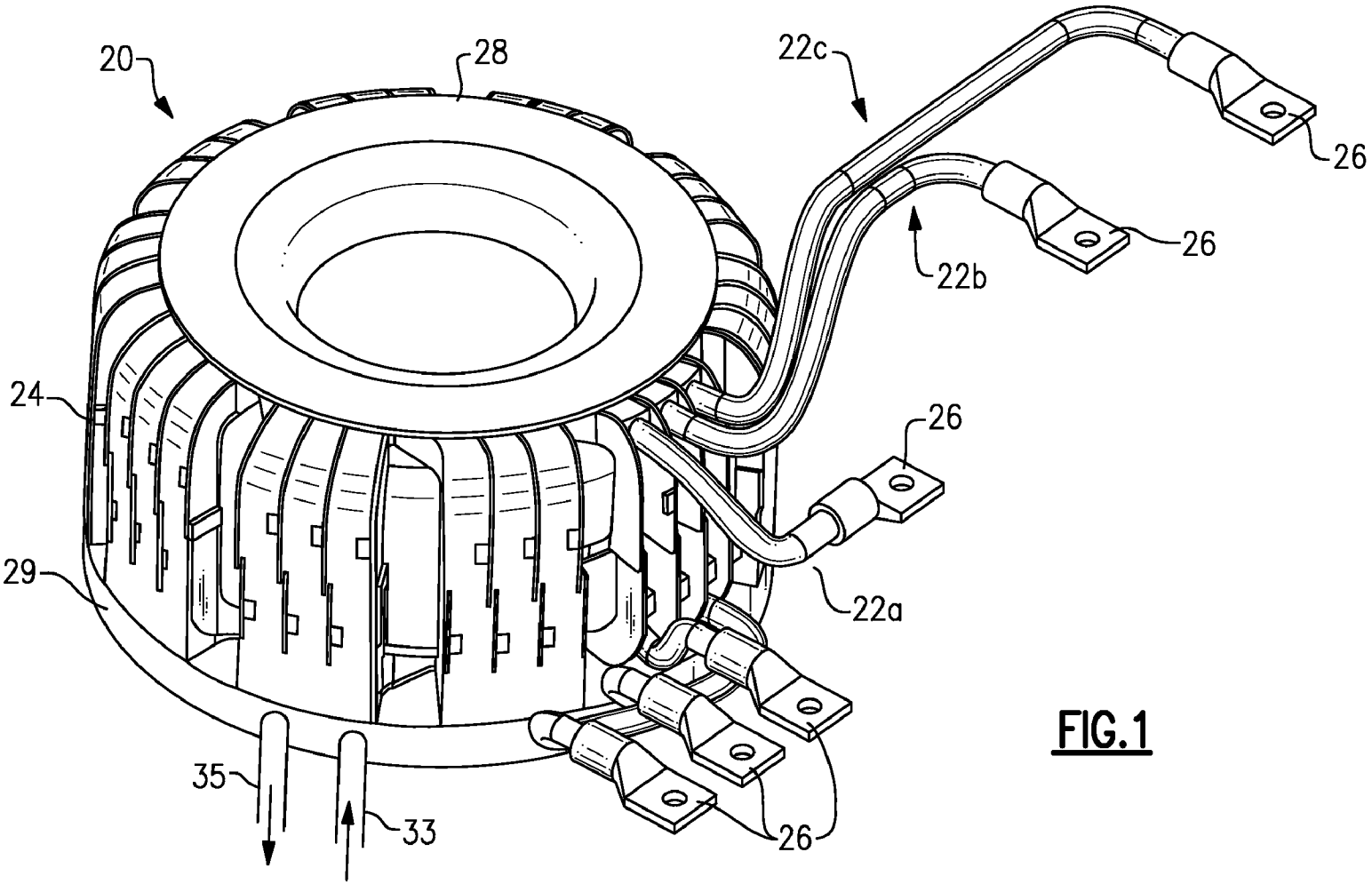
FIG. 1 illustrates a first view of an inductor assembly.

FIG. 1 schematically illustrates a first view of an electrical inductor assembly 20 which includes a plurality of wires 22*a*, 22*b*, 22*c* that are wrapped around a wire guide 24 to form a plurality of windings. Each of the wires 22*a*, 22*b*, 22*c* corresponds to a phase of electric current. In one example, the inductor assembly 20 is configured to be a common mode inductor, wherein each of the wires 22*a*, 22*b*, 22*c* are configured so that current flows through each of the wires in the same direction. A lug 26 is coupled to each end of each of the wires 22*a*, 22*b*, 22*c*. The plurality of lugs 26 provide a convenient way to fasten the wires 22*a*, 22*b*, 22*c* to other components in a system. Although three wires corresponding to three phases of current are illustrated in FIG. 1, it is understood that other numbers of wires could be used.

A heat sink 28 is thermally coupled to a first side and an inner perimeter of the wire guide 24, and a cold plate 29 is coupled to a second side, opposite the first side, of the wire guide 24. The cold plate 29 includes an inlet 33 and an outlet 35 that are fluidly connected to permit coolant to flow through the cold plate 29. In one example the wire guide 24 is made of a thermoplastic resin, such as Ultem®, and the heat sink 28 and cold plate 29 are made of an aluminum 6061 alloy. Obviously, other materials can be used.

Figure 2:
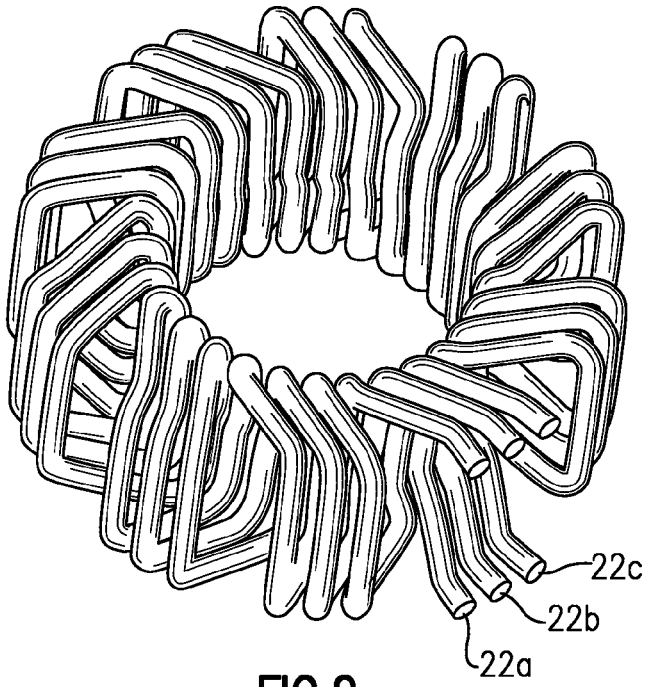
FIG. 2 illustrates a plurality of windings.

FIG. 2 schematically illustrates how the wires 22*a*, 22*b*, 22*c* form a plurality of windings. As shown in FIG. 2, each of the wires 22*a*, 22*b*, 22*c* has ten turns spanning 360°. Each of the wires 22*a*, 22*b*, 22*c* are wound closely together without physically contacting each other. Thus, each of the wires remains electrically isolated from each other. In one example the wires 22*a*, 22*b*, 22*c* are bare stranded wires, such as bare stranded copper, with no insulating outer layer. In this example, the bare wires are able to be tightly wound around tight curves in the slots of the wire guide 24, and are able to minimize leakage inductance by being in close proximity to each other.

Figure 3A:
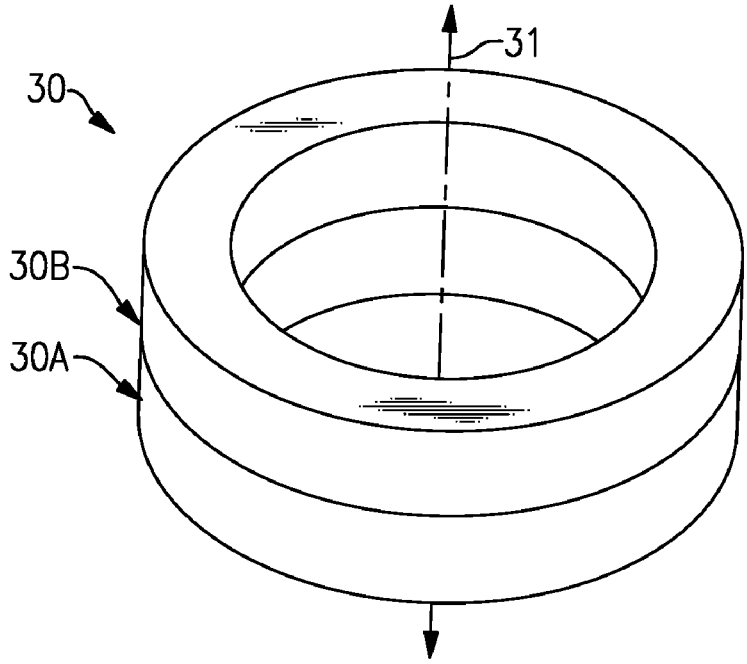
FIG. 3A illustrates an inductor core.
Figure 3B:
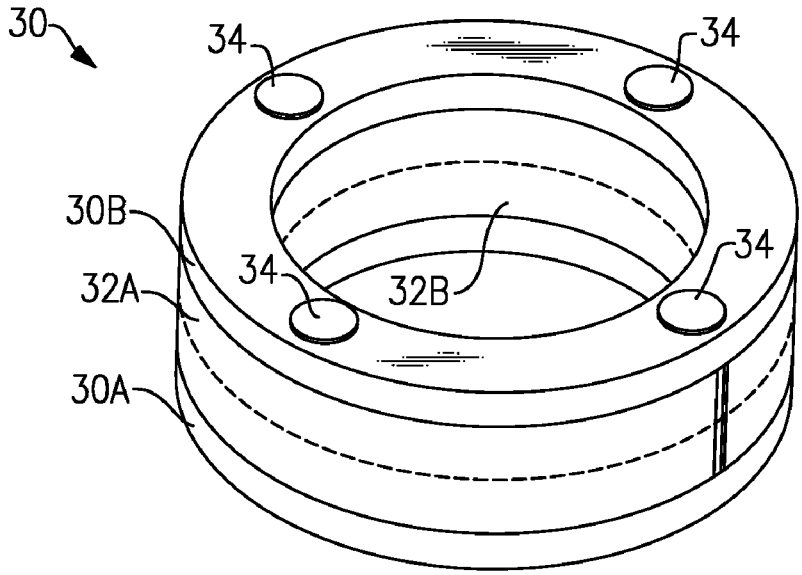
FIG. 3B illustrates the inductor core of FIG. 3A with an inner insulating layer and an outer insulating layer.

The wire guide 24 surrounds an inductor core 30 having a circular shape. The inductor core 30 is schematically illustrated in FIGS. 3A and 3B. An axis 31 is defined by the inductor core, and is perpendicular to a cross section of the inductor core 30. In one example, the inductor core 30 is formed from a first inductor core portion 30*a* and a second inductor core portion 30*b*. An outer insulating layer 32*a* may be applied to an outer perimeter of the inductor core 30, and an inner insulating layer 32*b* may be applied to and an inner perimeter of the inductor core 30 to fasten the first portion 30*a* to the second portion 30*b*, and to electrically isolate the inductor core 30 from the wires 22*a*, 22*b*, 22*c*. An adhesive 34 may also be applied to the inductor core 30 to fasten the inductor core 30 to the wire guide 24. In one example the inductor core 30 is made of a nanocrystalline magnetic material, such as Vitroperm® VP500F, the insulating layers 32*a*, 32*b* are made of an insulating tape, and the adhesive 34 is an RTF silicon adhesive. Of course, other materials may be used.

Figure 4:
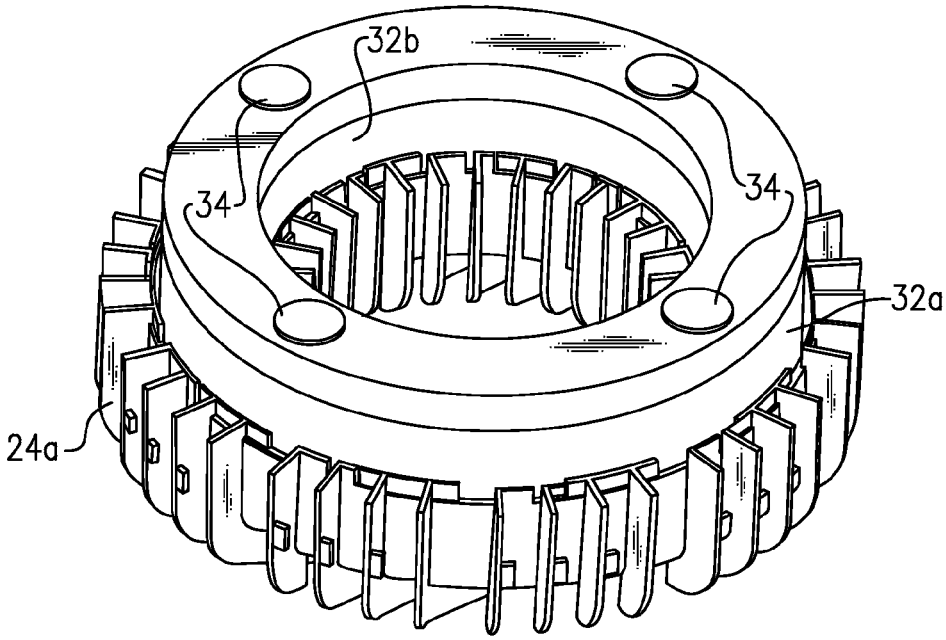
FIG. 4 illustrates a wire guide portion applied to the inductor core of FIG. 3*b*.
Figure 5:
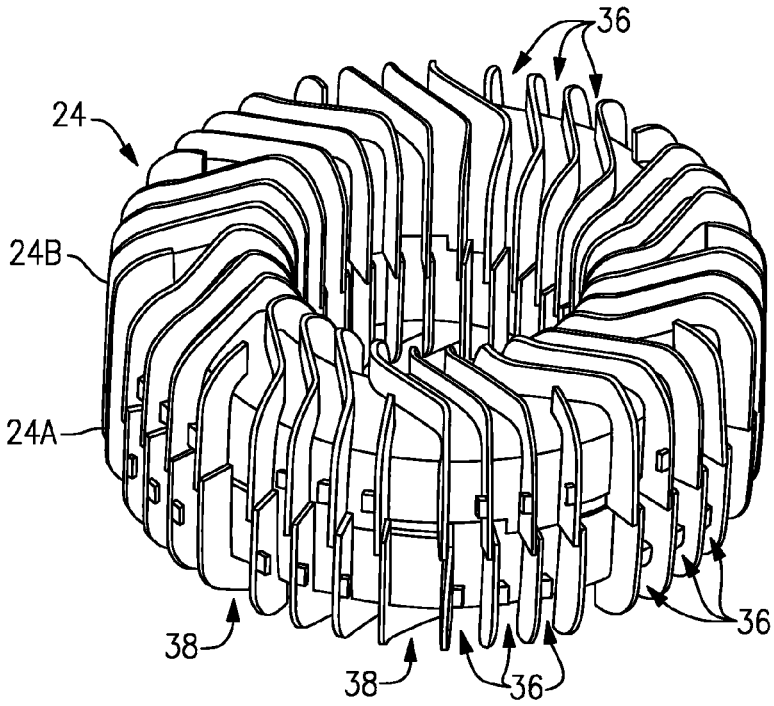
FIG. 5 illustrates the first wire guide portion and a second wire guide portion.

FIGS. 4 and 5 schematically illustrate how a first wire guide portion 24*a* may be applied to the first inductor core portion 30*a*, and a second wire guide portion 24*b* may be applied to the second inductor core portion 30*b*. The wire guide portions may be joined along an outer perimeter and in inner perimeter of the inductor assembly 20.

Figure 6:
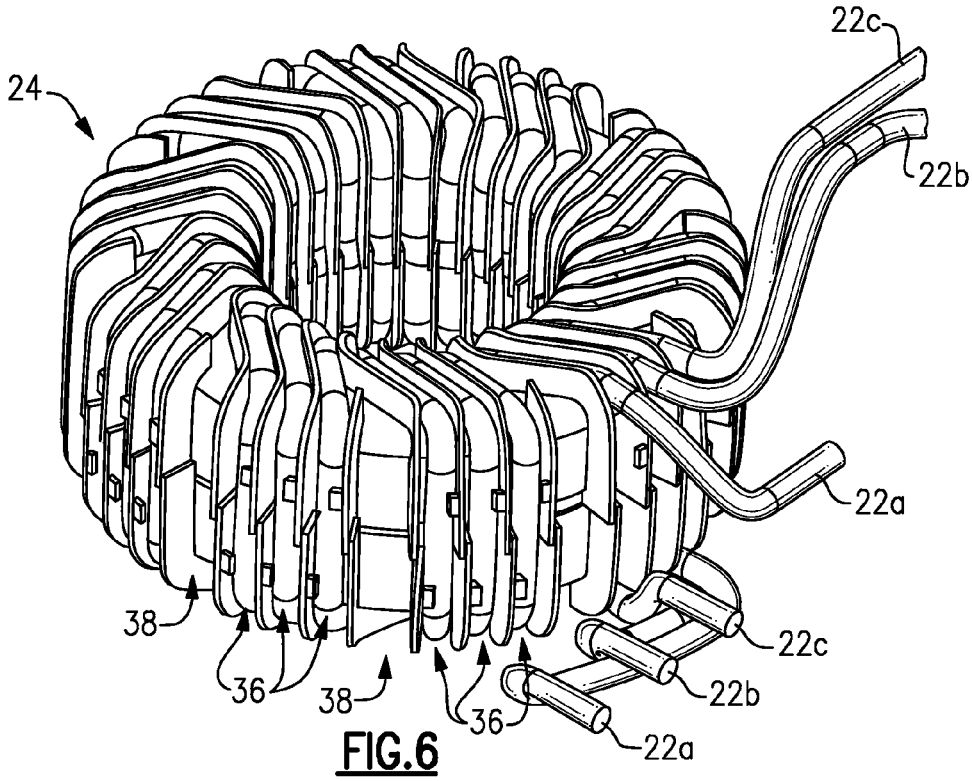
FIG. 6 illustrates a plurality of wires wrapped around the wire guide to form a plurality of windings.
Figure 6A:
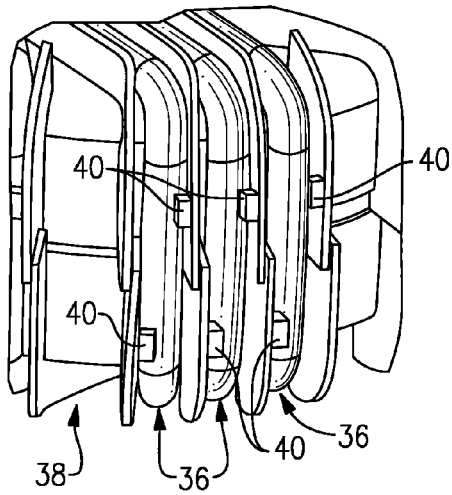
FIG. 6A illustrates a plurality of slot extensions.

As shown in FIG. 5, the wire guide 24 includes a plurality of slots 36 forming paths winding around the inductor core 30, and a plurality of slots 38 that align with the axis 31 and extend along an outer perimeter of the wire guide. As shown in FIG. 6, the slots 36 allow the plurality of wires 22*a*, 22*b*, 22*c* to be closely wound together around the wire guide while remaining electrically isolated from each other, and the slots 38 provide a gap between wire 22*a* and wire 22*c* at an outer perimeter of the wire guide 24. As shown in FIG. 6A, the slots 36 include a plurality of slot extensions 40 that retain the plurality of wires 22*a*, 22*b*, 22*c* within the slots 36.

Figure 7:
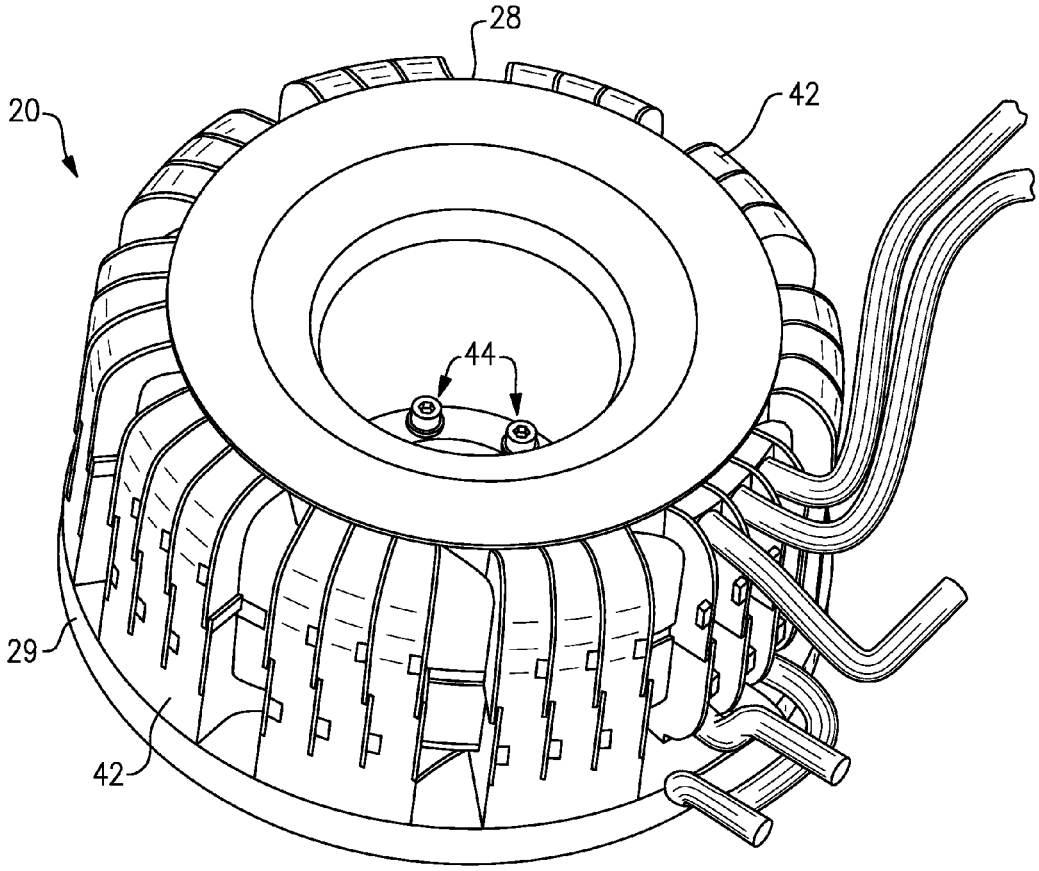
FIG. 7 illustrates a heat sink and an insulating material applied to several of the slots to insulate the plurality of wires.

FIG. 7 schematically illustrates the heat sink 28 thermally coupled to a first side and an inner perimeter of the wire guide 24. FIG. 7 also schematically illustrates an insulating material 42 placed into the slots 36 to electrically isolate the wires 22*a*, 22*b*, 22*c*, and to thermally couple the wires 22*a*, 22*b*, 22*c* to the heat sink 28 and to the cold plate 29. A plurality of fasteners 44 may be used to fasten the heat sink 28 to the cold plate 29.

Figure 8:
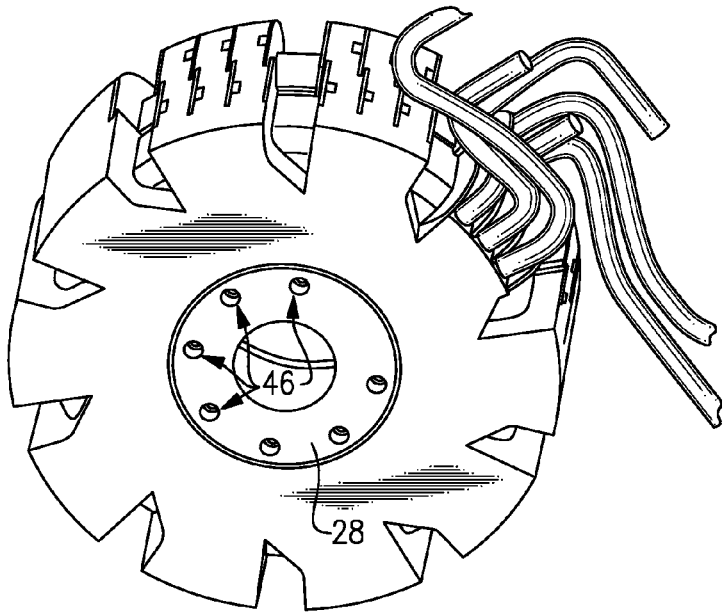
FIG. 8 illustrates a second view of an inductor assembly of FIG. 1.

FIG. 8 schematically illustrates a second view of the inductor assembly 20. As shown in FIG. 8, the heat sink 28 includes a plurality of holes 46 through which a fastener 44 may be inserted.

Figure 9:
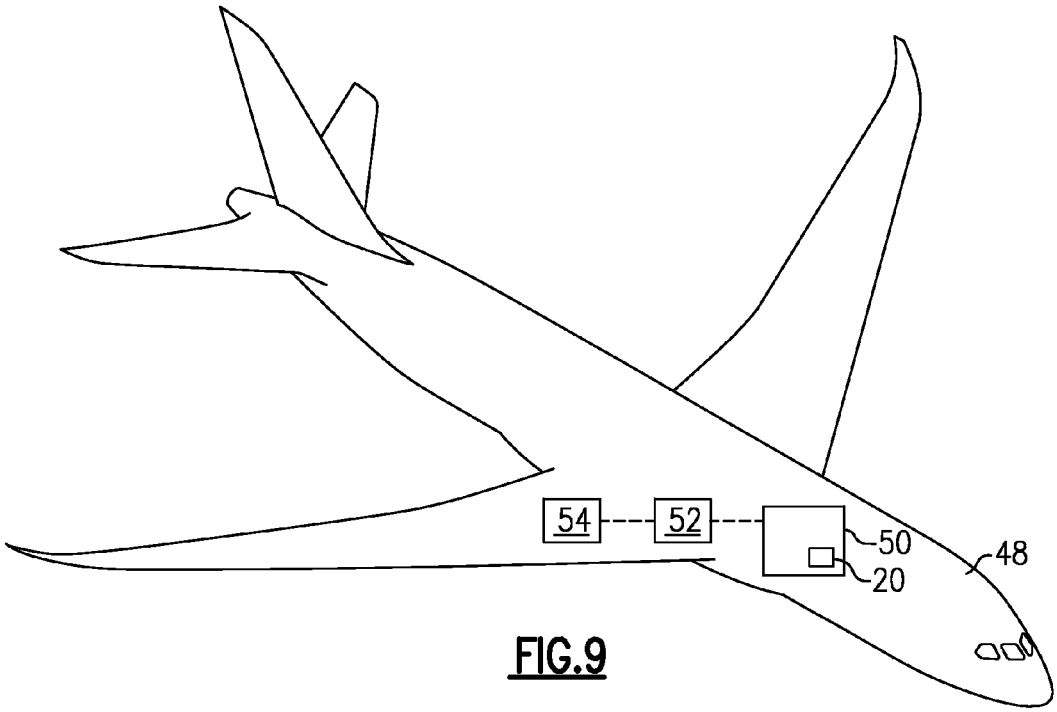
FIG. 9 shows the present invention in an example environment of an aircraft.

One example application for the electrical inductor assembly 20 is as a part of a power filter in a motor controller. FIG. 9 schematically illustrates an aircraft 48 that includes a motor controller 50, an electric motor 52, and a turbine engine 54. The inductor assembly 20 is part of the motor controller 50. The motor controller 50 is operable to deliver power to the electric motor 52, which may then rotate a shaft of the turbine engine 54. In one example, the electric motor 52 may also be used to actuate such components as a conveyor belt, a landing gear, and an auxiliary power supply. Although an aircraft 48 is illustrated in FIG. 9, it is understood that the inductor assembly could be used in other vehicles. Also, although the inductor assembly 20 is illustrated in a motor controller 50, it is understood that the inductor assembly 20 is not limited to this application.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An electrical inductor assembly, comprising:

an inductor core having a circular shape;

a wire guide that surrounds the inductor core, the wire guide comprising:

a first slot for a first wire;

a second slot adjacent to the first slot for a second wire;

a third slot adjacent to the second slot for a third wire, wherein the first slot, second slot, and third slot form paths that wind around the inductor core; and a fourth slot adjacent to the third slot to provide a gap between the third wire and another wire at an outer perimeter of the wire guide, wherein the gap terminates such that the gap is absent along an inner perimeter of the wire guide; and an insulating material placed in the slots containing the wires to electrically insulate the wires and to thermally couple the wires to at least one heat sink, wherein the insulating material fills the entire slot into which the wires are placed.

2. The assembly of claim 1, wherein the at least one wire is a bare wire.

3. The assembly of claim 1, wherein the first slot, the second slot, and the third slot include slot extensions that are operable to retain the first wire, the second wire, and the third wire within the first slot, the second slot, and the third slot.

4. The assembly of claim 1, wherein an insulating material is placed into the first slot, the second slot, and the third slot to electrically insulate the first wire, the second wire, and the third wire.

5. The assembly of claim 1, wherein the first, second, and third wire are wrapped around the inductor core to form a plurality of windings, and wherein the windings extend around an entire circumference of the inductor core.

6. The inductor of claim 1, where the inductor core comprises a top portion and a bottom portion secured along an inner perimeter by an inner electrically insulating layer, and secured along an outer perimeter by an outer electrically insulating layer.

7. The assembly of claim 1, further comprising:

a heat sink thermally coupled to the wire guide via the insulating material; and a cold plate thermally coupled to the wire guide via the insulating material.

8. The assembly of claim 7, wherein the cold plate includes an inlet and an outlet, wherein the inlet and the outlet are fluidly connected to permit coolant to flow through the cold plate.

9. The assembly of claim 7, wherein the heat sink is thermally coupled to a first side and an inner perimeter of the wire guide, and the cold plate is thermally coupled to a second side, opposite the first side, of the wire guide.

10. The assembly of claim 7, wherein the heat sink is fastened to the cold plate by at least one fastener.

11. A motor control system comprising:

an electric motor; and a motor controller, comprising:

an inductor core having a circular shape;

a wire guide that surrounds the inductor core, the wire guide comprising:

a first slot for a first wire;

a second slot adjacent to the first slot for a second wire;

a third slot adjacent to the second slot for a third wire, wherein the first slot, second slot, and third slot form paths that wind around the inductor core; and a fourth slot adjacent to the third slot to provide a gap between the third wire and another wire at an outer perimeter of the wire guide, wherein the gap terminates such that the gap is absent along an inner perimeter of the wire guide; and an insulating material placed in the slots containing the wires to electrically insulate the wires and to thermally couple the wires to at least one heat sink, wherein the insulating material fills the entire slot into which the wires are placed.

12. The motor controller system of claim 11, wherein the electric motor is operable to rotate an aircraft engine shaft.

13. An electrical inductor assembly, comprising:

an inductor core including a first ring portion coaxially aligned with a second ring portion;

a wire guide attached to an outside surface of the inductor core, the wire guide defining a first slot for a first wire, a second slot adjacent to the first slot for a second wire, and a third slot adjacent to the second slot for a third wire, wherein the first slot, second slot, and third slot form paths that wind around the inductor core, the wire guide further defining a fourth slot adjacent to the third slot to provide a gap between the third wire and another wire at an outer perimeter of the wire guide, wherein the gap terminates such that the gap is absent along an inner perimeter of the wire guide; and at least one heat sink thermally coupled to the wires.

14. The assembly of claim 13, where the first ring portion and the second ring portion are in contact with each other and are secured along an inner perimeter of the inductor core by an inner electrically insulating layer, and are secured along an outer perimeter of the inductor core by an outer electrically insulating layer.

15. The assembly of claim 13, wherein the plurality of second slots is coaxially aligned with the first and second ring portions.

16. The assembly of claim 13, wherein the at least one wire is a bare wire.

17. The assembly of claim 13, wherein the at least one heat sink includes a heat sink and a cold plate, the heat sink being fastened to the cold plate along an inner periphery of the assembly.

18. The assembly of claim 17, wherein the cold plate includes an inlet and an outlet, and wherein the inlet and the outlet are fluidly connected to permit coolant to flow through the cold plate.

* * * * *